United States Patent [19]

Wolfe

[11] 4,056,348

[45] Nov. 1, 1977

[54] GLOW COIL IGNITION SYSTEM WITH FLAME SENSING

[75] Inventor: Denis G. Wolfe, Santa Ana, Calif.

[73] Assignee: Robertshaw Controls Company, Richmond, Va.

[21] Appl. No.: 651,873

[22] Filed: Jan. 23, 1976

[51] Int. Cl.[2] ..... F23N 5/02

[52] U.S. Cl. ..... 431/66; 361/266; 431/67

[58] Field of Search ..... 431/66, 67; 317/98; 361/264, 266

[56] References Cited

U.S. PATENT DOCUMENTS

| | | | |
|---|---|---|---|
| 2,159,658 | 5/1939 | Hall | 431/67 X |
| 2,385,699 | 9/1945 | Fox | 431/66 X |
| 2,482,551 | 9/1949 | Korsgren | 431/66 |
| 3,183,959 | 5/1965 | Romanelli | 431/66 |
| 3,196,929 | 7/1965 | Miller et al. | 431/66 |
| 3,457,020 | 7/1969 | Hine, Jr. | 431/66 |
| 3,467,812 | 9/1969 | Terrell | 317/98 X |
| 3,495,925 | 2/1970 | Willson | 431/66 |
| 3,502,419 | 3/1970 | Perl | 431/66 |
| 3,609,072 | 9/1971 | Willson | 431/66 |
| 3,812,324 | 5/1974 | Faffaelli et al. | 317/98 |

*Primary Examiner*—Irwin C. Cohen
*Attorney, Agent, or Firm*—O'Brien & Marks

[57] ABSTRACT

The heat from an electric resistance igniter is used both (1) to start fuel flow to a burner after ignition temperature, and (2) to stop the fuel flow after a delay in the event of flame failure.

9 Claims, 6 Drawing Figures

GLOW COIL IGNITION SYSTEM WITH FLAME SENSING

BACKGROUND OF THE INVENTION

1. Field of the Invention

The invention relates to systems employing electric igniters for igniting burners, such as gas burners, and particularly to such systems which sense the temperature of the igniters to control the flow of fuel to the burners.

2. Description of the Prior Art

The prior art as exemplified in U.S. Pat. Nos. 389,151; 2,196,442; 2,196,443; 2,417,341; 2,482,551; 2,656,883; 2,703,606; 2,981,323; 3,162,366; 3,213,922; 3,233,830; 3,400,886 and 3,807,933, contains a number of burner ignition systems including systems which sense temperature of a resistance igniter to control the operation of a gas valve to a gas burner. The prior art burner ignition systems generally have one or more deficiencies such as being unduly complex, being unreliable, being excessively costly, etc.

SUMMARY OF THE INVENTION

The invention is summarized in a burner ignition system including fuel control means for a burner, an electrical resistance igniter adapted to be disposed in igniting proximity to the burner, first means operated by heat from the igniter for opening the fuel flow control means when the igniter is at fuel ignition temperature, second means operated by heat from the igniter for closing the fuel flow control means after a duration of operation of the first igniter heat operated means, and burner flame sensing means for preventing the operation of the second igniter heat operated means during the presence of a flame from the burner.

An object of the invention is to construct a burner ignition system which is reliable, inexpensive, and utilizes a minimum number of components to provide safety protection for the burner system.

Another object of the invention is to utilize the heat from an electrical resistance igniter to operate both a fuel start means and a flame failure turn off as well as to ignite the fuel.

It is also an object of the invention to utilize a single sensing unit for sensing igniter temperature and flame failure after a delay.

Another feature of the invention is to mount a temperature sensor on a hood covering the igniter with the sensor extending through the coil of the igniter.

Still another feature of the invention is the construction of a single inexpensive unit providing a restart attempt after failure in addition to igniter ignition temperature turn-on and flame failure turn-off.

Other objects, advantages and features of the invention will be apparent from the following description of the preferred embodiment taken in conjunction with the accompanying drawings.

DESCRIPTION OF THE PREFERRED EMBODIMENT

Figure 1:
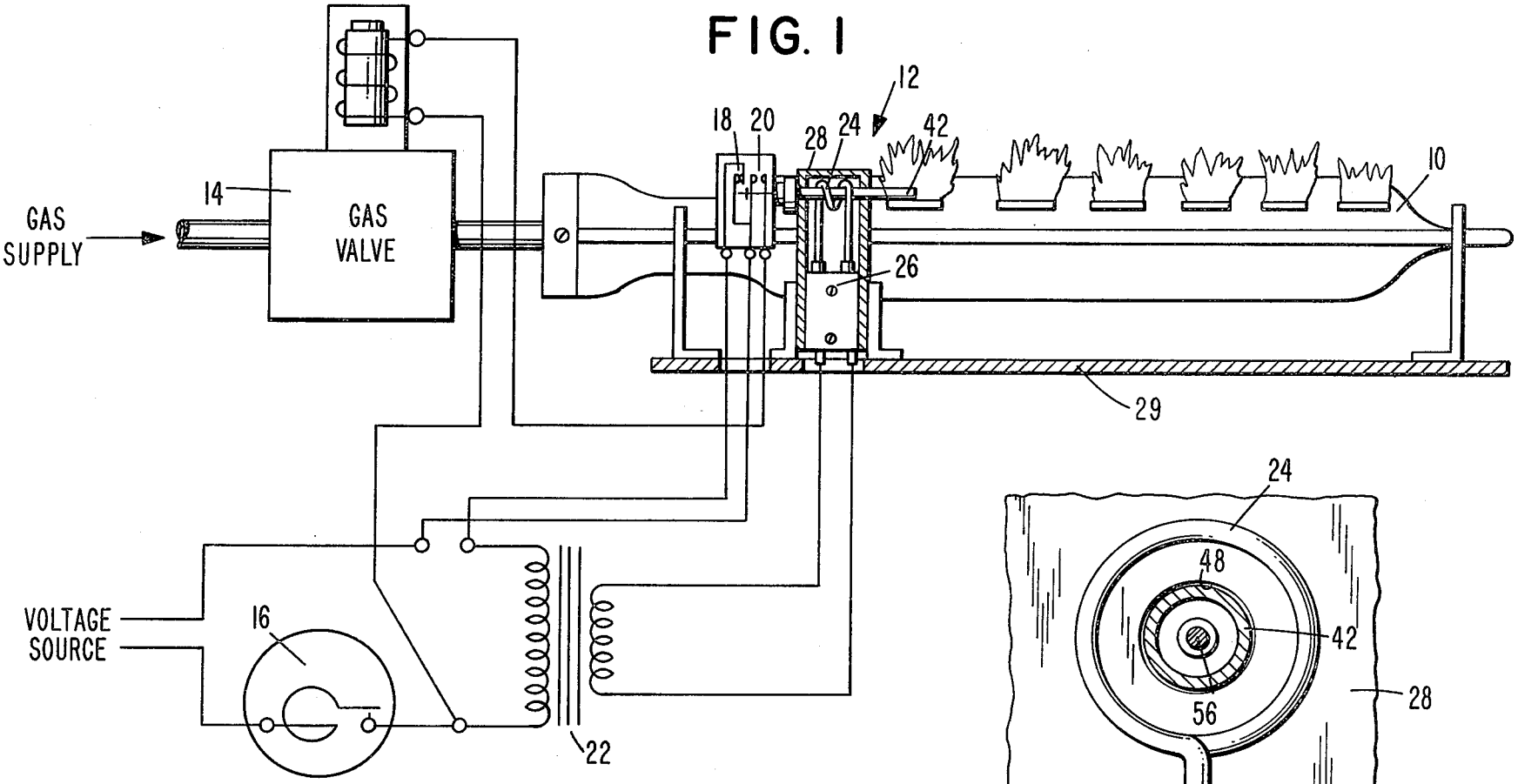
FIG. 1 is a diagram of a burner system in accordance with the invention.

As illustrated in FIG. 1, the invention is embodied in a burner system including a burner 10, such as may be used in a forced air furnace with an igniter and sensing assembly indicated generally at 12 controlling a fuel flow control device such as a gas valve 14 connected between the burner 10 and a gas supply. The gas valve 14 is electrically operated and has its solenoid winding connected in series with a thermostat switch 16 and a pair of normally open contacts 20 in the assembly 12 across a suitable voltage source. A pair of normally closed contacts 18 of the assembly 12 are connected in series with a primary winding of a transformer 22 and the thermostat switch 16 across the voltage source; the contacts 18 and primary winding being connected in parallel with the solenoid winding of the valve 14 and the contacts 20. The secondary winding of the transformer 22 is connected across the opposite ends of an electrical resistance igniter such as a molybdenum disilicide coil 24 having one or more complete convolutions.

Figure 2:
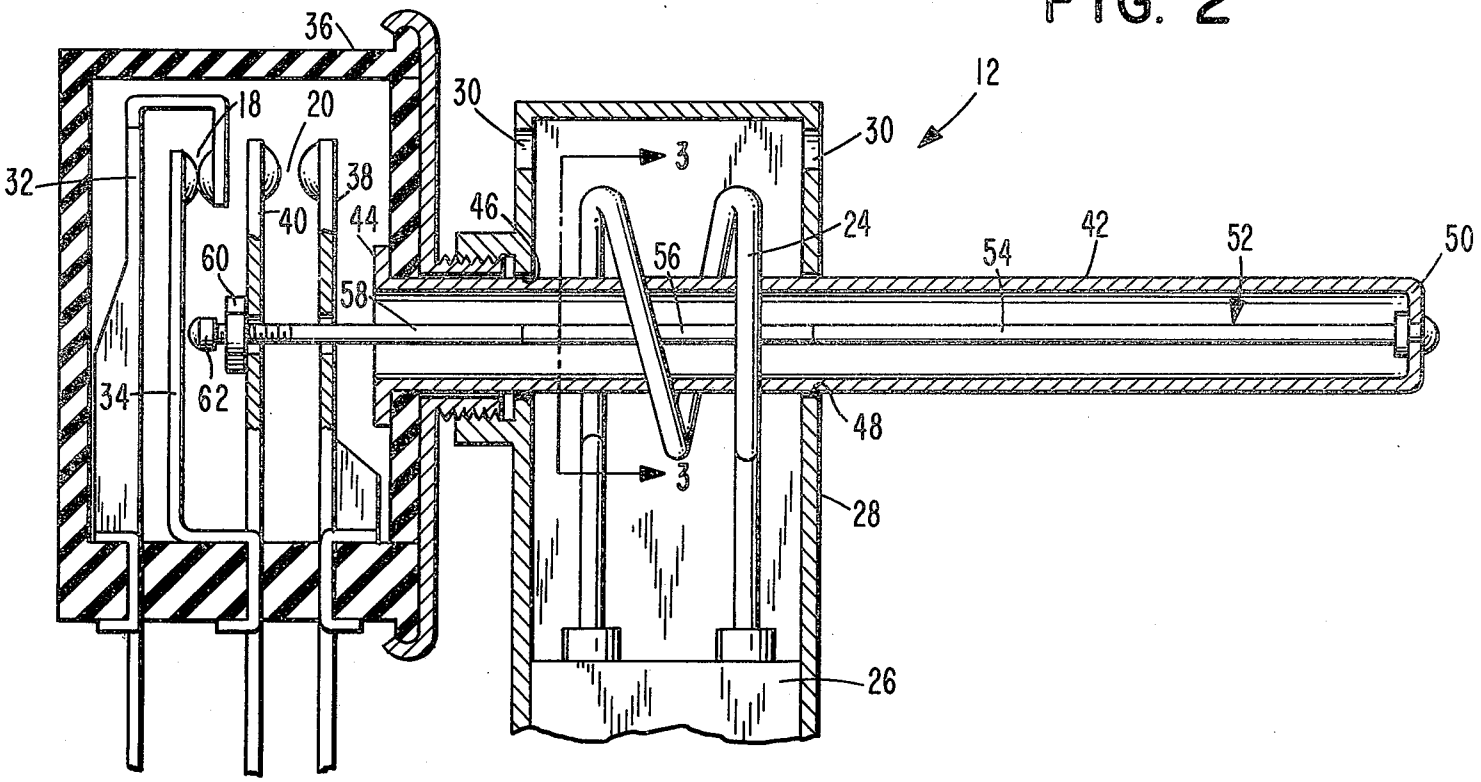
FIG. 2 is a cross section view of a burner ignition system in the burner system of FIG. 1.

As shown in FIG. 2 the igniter 24 is mounted at its opposite ends on an insulated block 26 upon which a hood or cover 28 enclosing the igniter coil 24 is secured. Referring back to FIG. 1 the whole assembly of the igniter 24, the block 26 and the hood 28 as well as the burner 10 are mounted by suitable bracket means on a support 29 such that the igniter coil 24 is in igniting proximity to the burner ports in the burner 10. The hood 28 has openings 30 therein suitable for passing gas from the burner 10 into the hood 28 to be ignited by the igniter coil 24.

The pair of contacts 18 are mounted respectively on a stationary arm 32 and a resilient arm 34 mounted in a suitable insulation switch housing 36 such that the resilient arm 34 normally biases the contacts 18 closed. The pair of contacts 20 are mounted respectively upon the ends of a stationary arm 38 and a resilient arm 40 mounted in the housing 36 such that the arm 40 normally biases the contacts 20 open. The housing 36 is suitably secured to the cover 28 such as by thread means.

Figure 3:
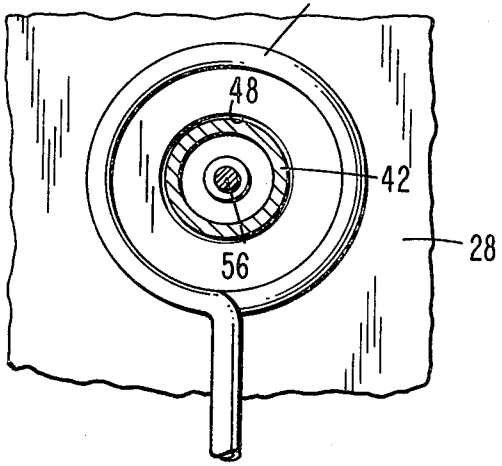
FIG. 3 is a view taken along line 3—3 of FIG. 2.

A tube 42 secured at one end 44 to the housing 36 extends through openings 46 and 48 in opposite sides of the cover 28 with a section of the tube 42 within the housing 28 extending coaxially, FIG. 3, through the coil 24 and with a section of the tube 42 outside the cover 28 toward the end 50 extending in the path of flame from the burner 10, see FIG. 1. A rod indicated generally at 52 is formed from rod sections 54, 56 and 58 joined serially by welds, crimped slip fits, or the like, and extends coaxially through the tube 42 in spaced relationship to the tube. The rod section 54 corresponds to the length of the tube 42 outside of the cover 28 and is suitably mounted on the end 50 of the tube 42. The section 56 corresponds to the section of tube 42 within the cover 28 while the remaining section 58 extends into the switch housing 36 and has its distal end extending through openings in the switch arms 38 and 40.

The rod section 54 is formed from a metal such as stainless steel 446, which has a relatively low coefficient of linear thermal expansion. The tube 42 and middle rod section 56 are formed from metals, such as Incoloy 800, which have a relatively high coefficient of linear thermal expansion. The rod section 58 is formed from a metal such as aluminum, with a still higher coefficient of linear thermal expansion than the rod section 56.

An adjustable abutment member, such as a nut 60 threaded on the end of the rod section 58, is secured on the rod section 58 for engaging the resilient contact arm 40 when the rod 52 is moved to the right as viewed in FIG. 2 to close the contacts 20. Another adjustable abutment member, such as a cap nut 62 threaded on the distal end of the rod section 58, is set to engage the resilient arm 34 to open the contacts 18 when the rod 52 expands to the left as viewed in FIG. 2.

In operation of the burner system shown in FIG. 1, the closing of the thermostat switch 16 indicating a demand for heat completes a circuit through the contacts 18 and the primary winding of the transformer 22 which energizes the igniter 24. When the igniter 24 reaches ignition temperature, the contacts 20 close to complete a circuit through the winding of the solenoid of the gas valve 14 to open the gas valve 14 and pass gas to the burner 10. Under normal conditions the fuel is ignited by the igniter 24 and the contacts 20 are maintained closed during the presence of a flame. In the event that there is a failure of ignition or the flame is extinguished, the contacts 20 open after a delay disrupting the circuit through the solenoid of the gas valve 14 to stop the flow of gas to the burner 10. After a further delay, the contacts 18 are opened which to deenergize the igniter 24 allowing the igniter 24 to cool whereupon the contacts 18 are closed and another attempt to ignite the burner is made.

Figure 4:
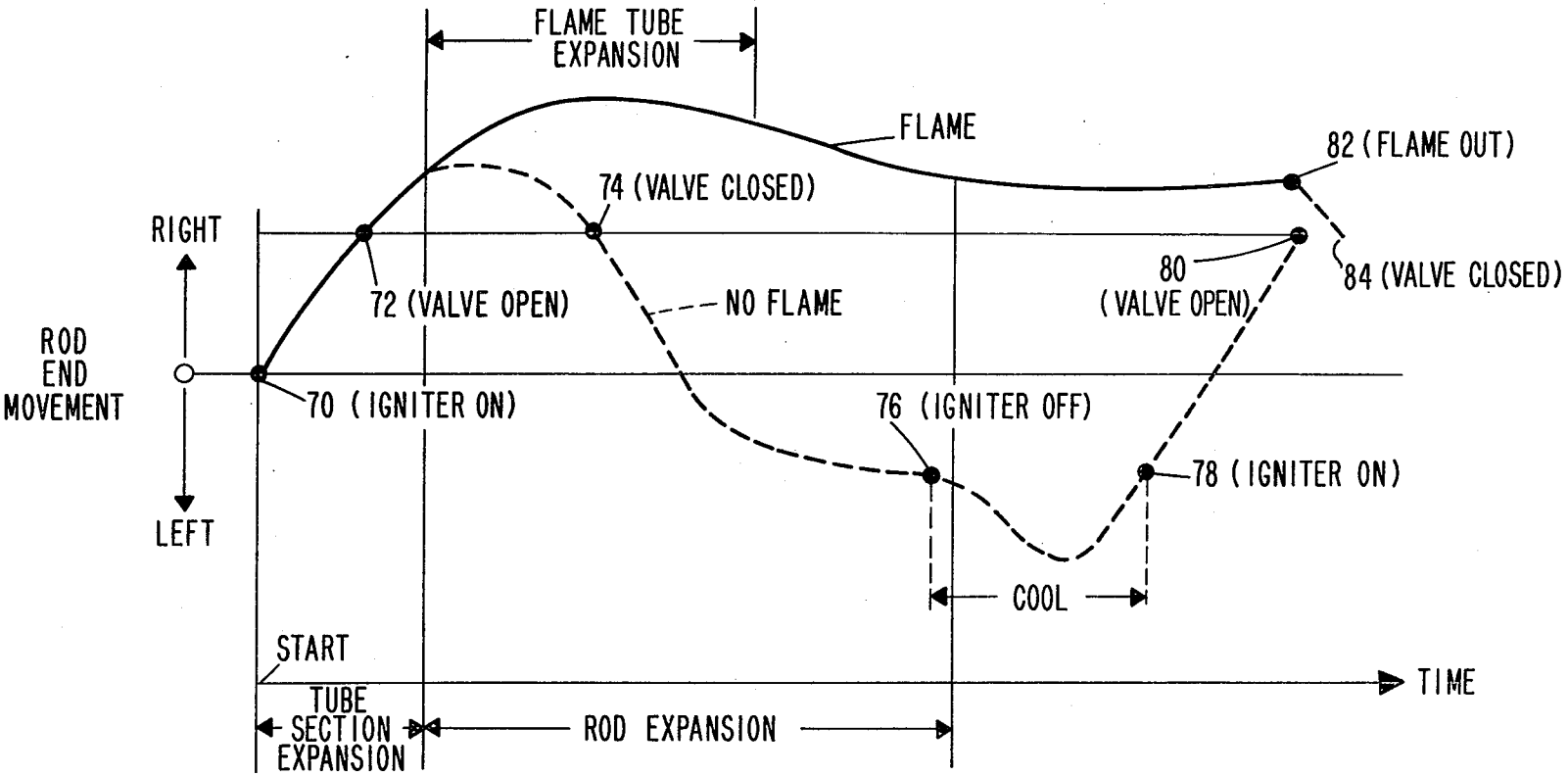
FIG. 4 is a graph illustrating movement of a sensing rod in the ignition system of FIG. 2.

More particularly, refering to FIG. 2, the heat from the igniter 24 causes the section of the tube 42 within the cover 28 to expand resulting in the linear movement of the rod 52 from point 70, FIG. 4, to the right which causes the abutment 60 to engage and move the arm 40 to close the contacts 20 at point 72 when the igniter 24 reaches ignition temperature. Since the rod section 56 is positioned centrally and spaced from the tube 42 it is heated much more slowly from heat from the igniter than the tube section 42 in the cover 28 but eventually expands tending to move the distal end of the rod section 58 to the left. The rod section 58 is heated even slower than the rod section 56 since it is heated mainly by conduction from the rod section 56. Flame impinging on the section of the tube 42 outside the cover 28 causes that section to expand which counteracts the expansion of the rod sections 46 and 48 maintaining the contacts 20 closed.

In the event that there is a flame failure, or a flame out such as at point 82, the tube section 42 outside of the cover 28 does not expand significantly and the expansion of the rod sections 56 and 58 causes the opening of the contacts 20 at point 74 (or 84) to stop fuel flow. Continued heating of the rod sections 56 and 58 by the igniter 24 or cooling of the outside tube section eventually results in engagement of the abutment 62 with the resilient arm 34 opening the contacts 18 at point 76. After the igniter 24 and the tube 42 as well as the rod sections 56 and 58 have cooled considerably, the shrinkage of the rod sections 56 and 58 result in the closing of the contacts 18 at point 78 to reenergize the igniter 24 to again open the valve, at point 80 and attempt to ignite the burner.

It is particularly advantageous to utilize the heat from the igniter coil 24, in addition to igniting the fuel, to operate (1) an igniter ignition temperature sensor such as the heat motor or tube 42 (2) a delay means such as the heat motor or rod section 56, and (3) a further delay means such as the heat motor or rod section 58; this forms a relatively simple structure with few parts. It is noted that types of sensors and delay means, or heat motors operated by igniter heat, other than the described rod and tube arrangement could be readily used. Although it is preferred and advantageous for the sensing and delay means to centrally extend through the igniter coil 24, other relative positioning of the sensor and delay means, such as outside the coil 24, could provide adequate heat transfer to operate the sensor and delay means.

It is advantageous that the tube 42 extends centrally through the coil 24 in spaced relationship thereto within the housing 28 since this arrangement provides for relatively even and optimum radiant heat transfer to the tube 42 without interfering with the exposure and heating of the igniter 24. The housing 28 protects the coil 24 from drafts or direct impingement of fuel from the burner which could result in cooling of the ignition element 24 sufficiently to prevent ignition as well as reflecting radiant energy back onto the section of tube 42 within the hood 28.

Figure 5:
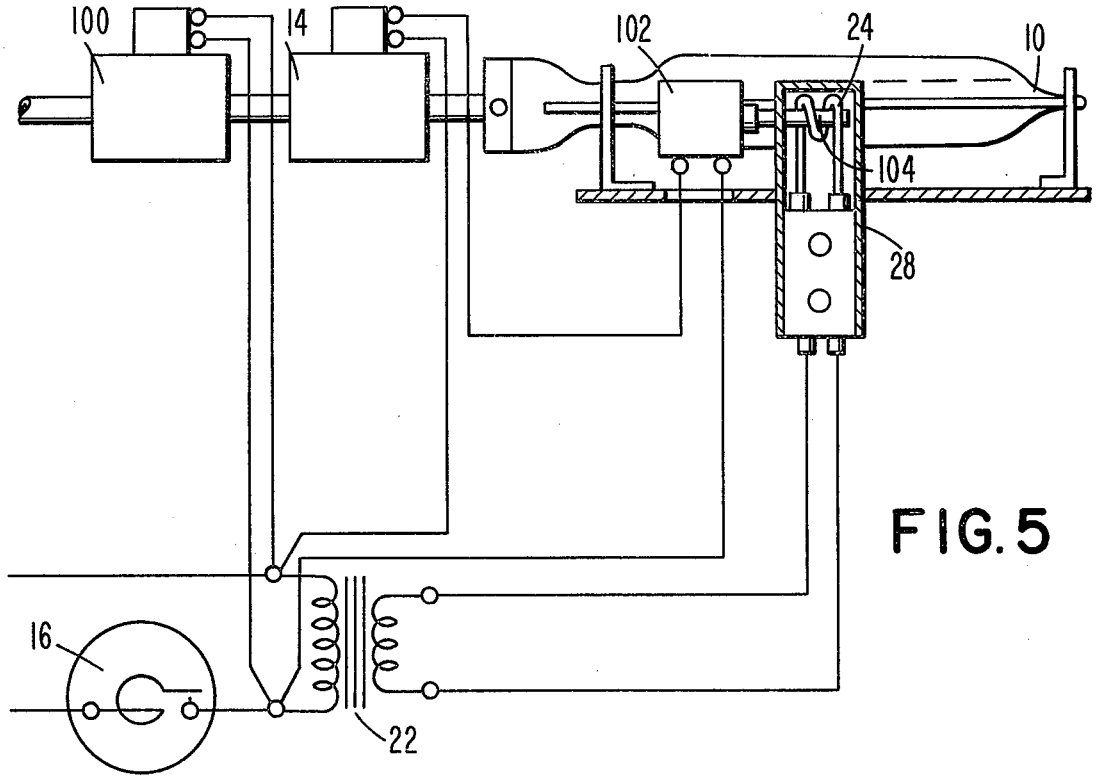
FIG. 5 is a diagram of a modified burner system.

In the modification shown in FIG. 5, various parts are identified by the same numerals used to identify parts of the burner system in FIGS. 1–3 indicating that such commonly identified parts have substantially similar function and structure. A valve 100 is interposed in the input to the burner 10 and has an operating winding connected in series with the thermostat switch 16 across the voltage source to shut off the fuel to the burner 10 when the thermostat switch 16 opens. Additionally, the modification of FIG. 5 has a sensor 102 with a conventional tube and rod combination 104 (the tube and rod having different co-efficients of thermal expansion) extending into one side of the cover 28. The sensor 102 has a single set of contacts which are closed by the heating of the tube and rod combination 104 to open the valve 14. The rod and tube combination 104 extends coaxially through the igniter coil 24 as in the embodiment of FIG. 1.

Figure 6:
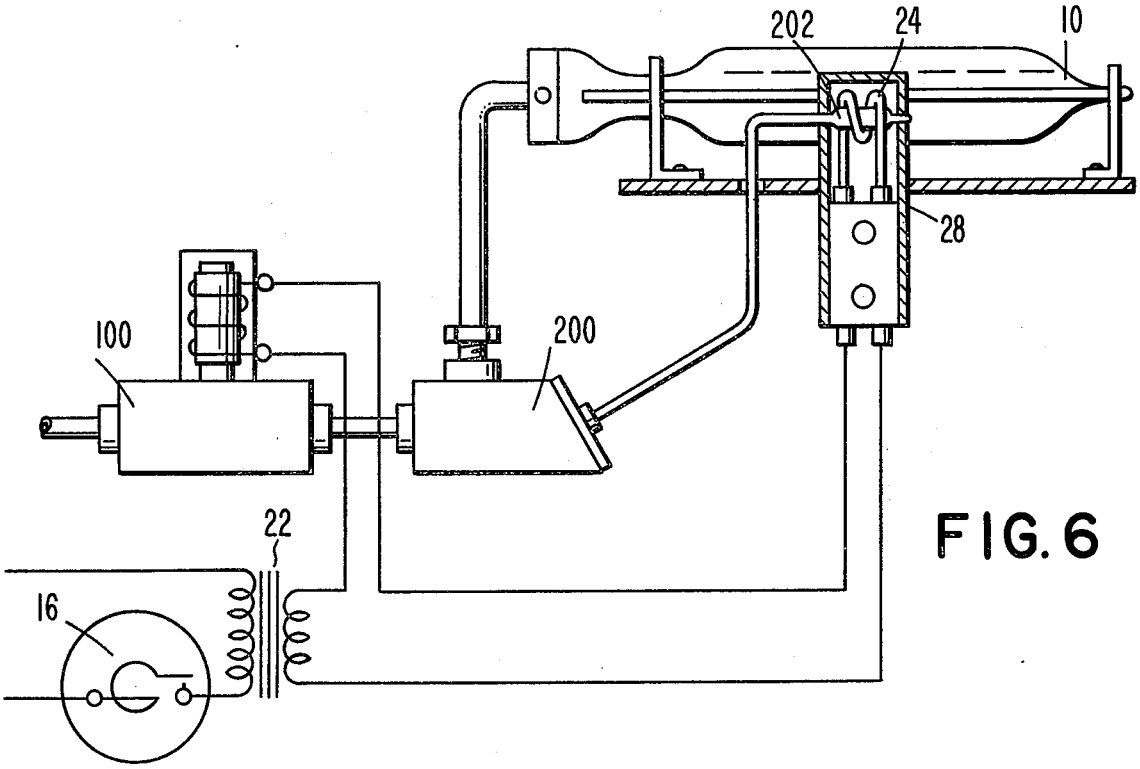
FIG. 6 is a diagram of another modified burner system.

In the modification of FIG. 6, the solenoid valve 100 is connected in series with the secondary winding of the transformer 22 and the igniter coil 24. Also the sensor 102 and solenoid valve 14 of FIG. 5 are replaced by a valve 200 which is operated by a bulb sensor 202 centrally positioned within the igniter coil 24 in the cover 28. The valve 200 is a conventional valve which is operated by a liquid, such as mercury, or a gas within the bulb 202. Again the arrangement of the cover 28 and the central position of the bulb 202 within the igniter coil 24 allows for maximum efficiency in the operation of the sensor 202 and the burner valve 200.

Since many modifications, changes in detail, and variations may be made to the presently described embodiments, it is intended that all matter in the foregoing description and shown in the accompanying drawings be interpreted as illustrative and not in a limiting sense.

What is claimed is:

1. A burner ignition system comprising fuel flow control means, an electrical resistance igniter, first means operated by heat from the igniter for opening the fuel flow control means when the igniter is at fuel ignition temperature, second means operated by heat from the igniter overriding the operating first igniter temperature operated means for closing the fuel flow control means after a duration of operation of the first igniter temperature responsive means, and burner flame sensing means for overriding the operating second igniter heat operated means during the presence of a flame.

2. A burner ignition system as claimed in claim 1 wherein the first and second means operated by heat from the igniter include respective first and second heat motors operated by heat from the igniter.

3. A burner ignition system as claimed in claim 2 wherein the first and second heat motors include respective first and second elongated thermally expansive metal members.

4. A burner ignition system as claimed in claim 3 including a support, an elongated tube of a metal having a high coefficient of thermal expansion and mounted at one end of the support, said tube having a first tube section extending adjacent the igniter and forming the first thermally expansive member, said tube having a second tube section extending away from the igniter to form the burner flame sensing means, and an elongated rod extending coaxially through the tube and having one end joined to the other end of the tube, said rod having a first rod section within the first tube section and formed from metal having a high coefficient of thermal expansion to form the second thermally expansive member, said rod having a second rod section within the second tube section and formed from a metal having a low coefficient of thermal expansion, and the other end of the rod being connected to the fuel flow control means.

5. A burner ignition system as claimed in claim 1 including third means operated by the heat from the igniter after the operation of the second means for interupting energization of the electrical resistance igniter for a duration sufficient to substantially cool the igniter whereby the system is reset.

6. A burner ignition system as claimed in claim 5 wherein the first, second and third means operated by heat from the igniter include respective first, second and third heat motors.

7. A burner ignition system as claimed in claim 6 including a support, an elongated tube of a metal having a high coefficient of thermal expansion and mounted at one end of the support, said tube having a first tube section extending adjacent the igniter and forming the first heat motor, said tube having a second tube section extending away from the igniter to form the burner flame sensing means, an elongated rod extending coaxially through the tube and having one end joined to the other end of the tube, said rod having (1) a first rod section within the first tube section and formed from a metal having a high coefficient of thermal expansion to form the second heat motor, (2) a second rod section within the second tube section and formed from a metal having a low coefficient of thermal expansion, and (3) a third rod section extending from the first rod section opposite the second rod section and formed from a metal having a high coefficient of thermal expansion to form the third heat motor operated by thermal conduction from the first rod section.

8. A burner ignition system as claimed in claim 7 wherein said fuel flow control means includes an electrically operated valve and a normally open switch connected in series with the valve, and means for closing the normally open switch when the first tube section is expanded by heat from the igniter, said closing means being respective to expansion of the first rod section for reopening the normally open switch upon a failure of expansion of the second tube section by flame heat, and said third means includes a normally closed switch connected in series with the igniter and means responsive to the expansion of the third rod section by heat from the igniter in the absence of flame to open the normally closed switch.

9. A burner ignition system as claimed in claim 8 wherein the electrical resistance igniter is elongated and has a coil with at least one complete convolution with the opposite ends of the igniter mounted on the support, and including a hood mounted on the support and enclosing the resistance igniter, said hood having first openings to allow a fuel and air mixture to enter the hood and contact the resistance igniter and having a second opening, said tube mounted at its one end on the hood and extending coaxially through coil and through the second opening with the second tube section being outside of the hood.

* * * * *